United States Patent [19]

Merritt

[11] Patent Number: 4,465,241

[45] Date of Patent: Aug. 14, 1984

[54] APPARATUS AND METHOD FOR SHAPING A WOUND YARN PACKAGE

[75] Inventor: Herbert C. Merritt, Waynesboro, Va.

[73] Assignee: E. I. Du Pont de Nemours and Company, Wilmington, Del.

[21] Appl. No.: 479,737

[22] Filed: Mar. 28, 1983

[51] Int. Cl.[3] ..... B65H 54/00

[52] U.S. Cl. ..... 242/1; 242/18 DD; 242/18 R; 242/47; 242/159; 242/168

[58] Field of Search ..... 242/1, 18 R, 47, 18 DD, 242/159, 168, 169

[56] References Cited

U.S. PATENT DOCUMENTS

| | | | |
|---|---|---|---|
| 480,158 | 8/1892 | Wardwell, Jr. | 242/168 X |
| 1,591,020 | 7/1926 | Damon | 242/159 X |
| 2,025,920 | 12/1935 | Webber | 242/1 |
| 2,618,015 | 11/1952 | Lloyd | 242/169 X |
| 2,674,215 | 4/1954 | Thompson, Jr. et al. | 242/168 |
| 2,857,113 | 10/1958 | Küpper . | |
| 3,361,372 | 1/1968 | Pesch . | |
| 3,365,145 | 1/1968 | Klink et al. . | |
| 3,367,587 | 2/1968 | Klink et al. . | |
| 3,371,877 | 3/1968 | Klink et al. . | |
| 3,498,550 | 3/1970 | Klink et al. . | |
| 3,652,025 | 3/1972 | DiMauro . | |
| 3,801,032 | 4/1974 | Sears et al. . | |
| 3,845,912 | 11/1974 | Eichmanns et al. . | |
| 4,377,262 | 3/1983 | Zajac | 242/1 |

*Primary Examiner*—Stanley N. Gilreath

[57] ABSTRACT

An apparatus and method for shaping shoulders of a cylindrical yarn package by rotating the package about its central axis and applying pressure to both shoulders of the package simultaneously. One apparatus embodiment includes drive rolls for rotating the package and rotatable elongated shaping elements mounted for movement into and out of engagement with the shoulders of the package. The positioning of the rollers with respect to the point of contact on the package shoulders is important to the operation of the apparatus.

16 Claims, 7 Drawing Figures

APPARATUS AND METHOD FOR SHAPING A WOUND YARN PACKAGE

BACKGROUND OF THE INVENTION

This invention relates to cylindrical-bodied yarn packages wherein the yarn is traverse wound in layers of helical coils on a yarn package support, more particularly it relates to an apparatus and method for shaping such packages after they are wound to improve their formation and stability. Such packages are commonly formed by windups employing a surface drive. The drive roll is operated at a constant speed thus maintaining a constant surface velocity of the driven package despite the growth of the package as the filament material is wound thereon. A cam-actuated reciprocating traverse guide may be used to lay the yarn onto the package support in layers of helical coils either directly or by means of a print roll.

When winding elastic textile yarns, such as spandex fibers of the type sold under the trademark "LYCRA", into packages in this fashion, package deformation in the form of bulges or lips on the shoulder of the package occur which appear to be related in some way to the retractability of the yarn at the reversals of the helical coils formed by the successive strokes. These lips are undesirable inasmuch as the yarn sloughs from the package during unwinding causing breaks. The solution to the problem is to reshape the shoulder of the package to eliminate the lips which are formed during windup. Currently reshaping is done by hand. An operator moves the heel of his hand around the sidewall and shoulder of the package spreading out the lips. Following this shaping operation the operator finds the free lead end of the yarn and ties it around the package surface for ease of retrieval during later processing of the package. This method of reshaping and finding free ends on elastic textile yarn packages is slow and does not provide the efficiency desired in such an operation. The efficiency of the reshaping operation is greatly improved by mechanically performing the operation through the use of an apparatus which will both reshape the shoulders of the package as well as locate the free lead end of the package.

SUMMARY OF THE INVENTION

According to the present invention, mechanically shaping the opposed shoulders of a cylindrical yarn package having lips formed on the shoulders during winding is accomplished by rotating the package about its central axis and applying pressure to both shoulders simultaneously with an apparatus that comprises a base, a pair of driven rollers rotatably mounted to the base for rotating a yarn package supported thereon, and a pair of rotatable elongated shaping elements mounted to the base for movement into and out of contact with a point on the opposed shoulders of the yarn package. The shaping elements are positioned so that their longitudinal axes are at an angle of from about 5 degrees to about 65 degrees with respect to a radius of the package extending to the contact point of the shaping elements with the shoulders of the package. The driven rollers are spaced from each other in substantial parallelism and each are driven by a motor at about 50–100 revolutions per minute. In one embodiment a suction nozzle is positioned below the rollers within the space between the rollers to locate a loose lead end of yarn on the package.

In the preferred embodiment the shaping elements are conical with a cone angle of from about 15 to about 20 degrees and apply a force having a component directed toward the shoulder of the package. Usually when reshaping elastic textile yarn packages, a force of from $\frac{1}{4}$ to $\frac{3}{4}$ pounds is sufficient; however, means are provided to increase or decrease this force if desired.

DETAILED DESCRIPTION OF THE ILLUSTRATED EMBODIMENTS

Figure 1:
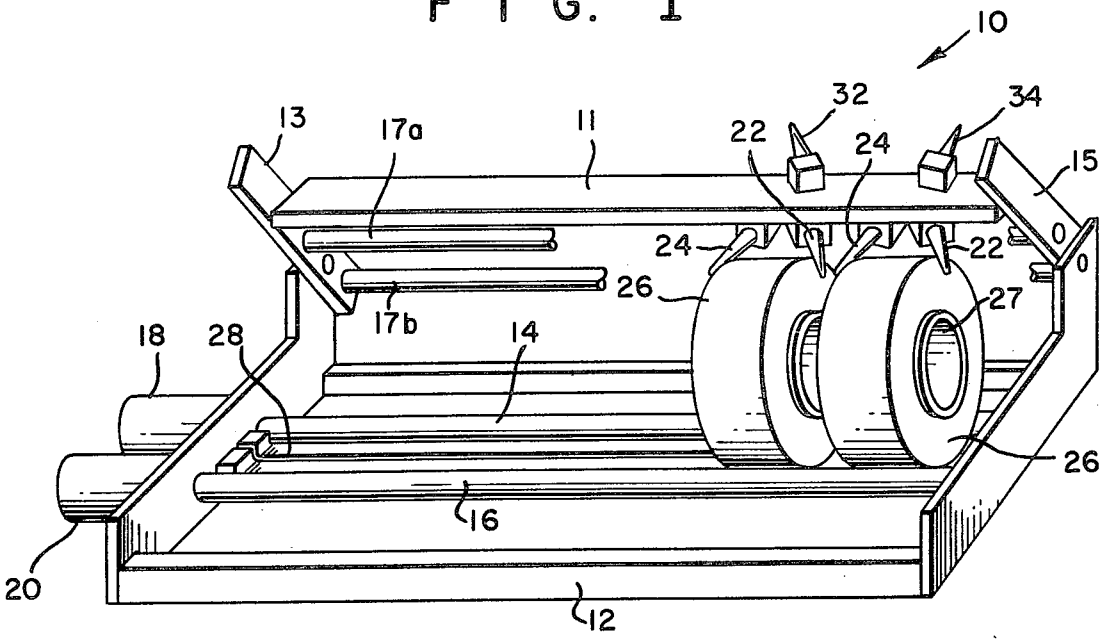
FIG. 1 is a perspective view of the apparatus of this invention.
Figure 2:
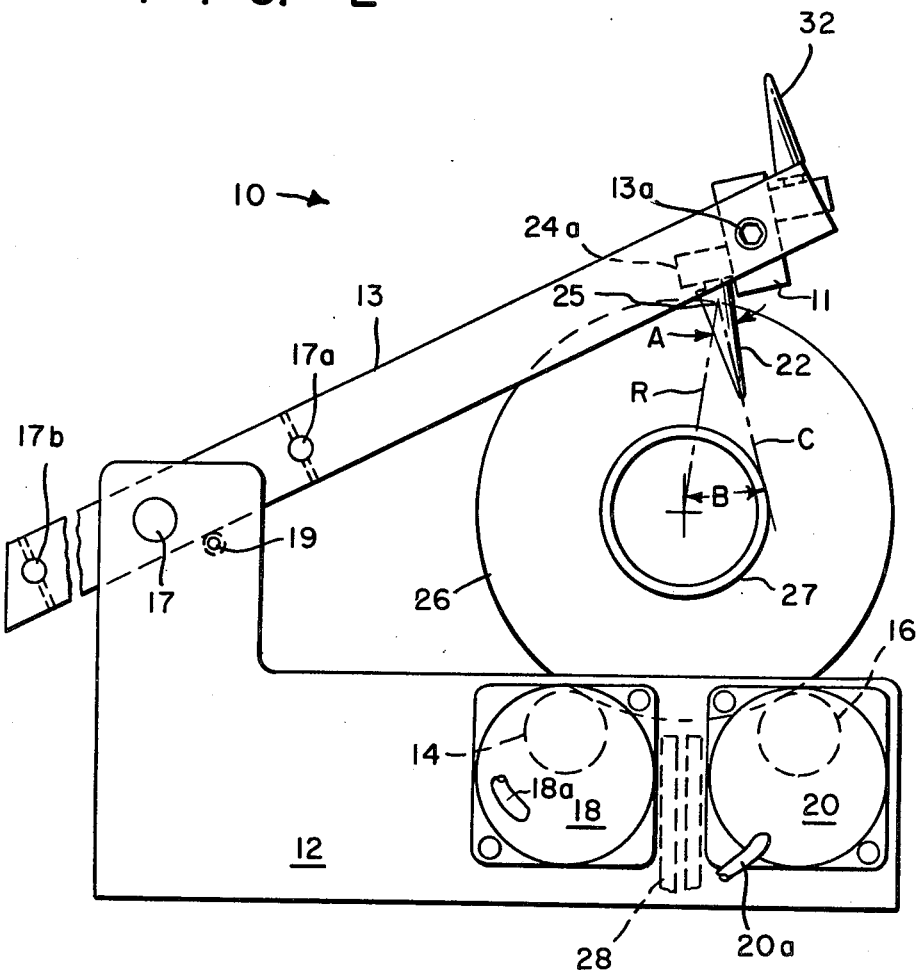
FIG. 2 is a side elevation view of one embodiment of the invention.
Figure 3:
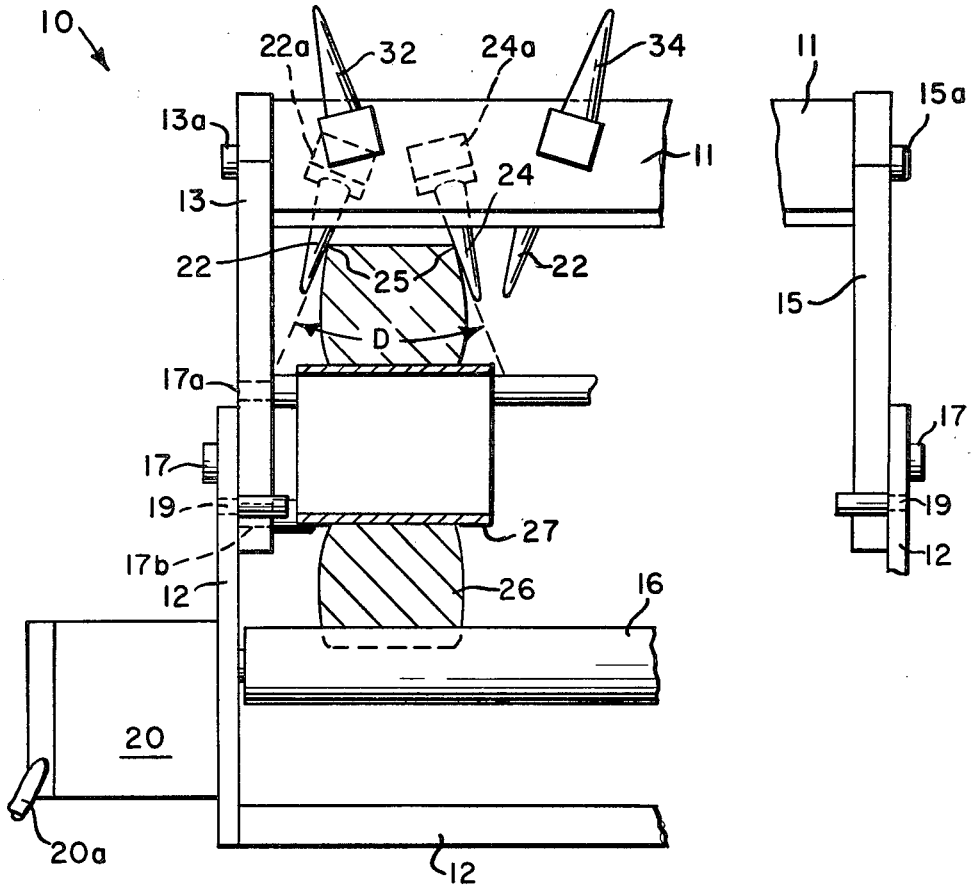
FIG. 3 is a front elevation view of FIG. 2.

Referring now to FIGS. 1–3, the shaping apparatus chosen for purposes of illustration is denoted generally as 10 and includes as major components, a base 12, a pair of substantially parallel drive rollers 14, 16 rotatably mounted to the base and driven by motors 18, 20, connected to a power source (not shown) by leads **18*a*, 20*a* respectively, a pair of elongated shaping elements 22, 24 contacting a point 25 on the shoulders of elastic textile yarn packages 26. Below, between and in close proximity to drive rolls 14, 16 is a suction nozzle 28 which may be adjustable to place it close to package 26** so when a vacuum is applied to the nozzle the free lead end of the package will be picked up by the nozzle and located for securing by subsequently tying around the yarn package. Without the vacuum nozzle pickup an inordinate amount of time is required for an operator to find free ends particularly on light denier yarn packages.

The elongated shaping elements 22, 24 are conical in shape with a cone angle A (FIG. 2) of up to about 30 degrees (15–20 degrees being a preferred range) and generally are about 1–$\frac{1}{2}$ inches (3.81 cm) long with a $\frac{1}{2}$ inch (1.27 cm) base. The longitudinal axis C of the shaping elements makes an angle B with the radius R of the package 26. Radius R extends to the point of contact 25 of the shaping element 22 with the package. This angle B is known as the cant angle and has an operable range of from about 5 degrees to about 65 degrees.

The included angle D (FIG. 3) between the surfaces of the conical shaping elements 22, 24 at their points of contact (25) with the shoulders of package 26 is known as the divergence angle and has an operable range of between 10 degrees to 65 degrees with the preferred range being between 35 and 50 degrees.

The shaping elements are all mounted to a bar 11 supported by arms 13, 15 which are pivotally mounted to base 12 at pivots 17. A roll pin 19 fastened to base 12 engages arms 13, 15 and serves as a stop for forward movement of the arms. Each conical shaping element is a roller rotatably mounted in a mounting block, e.g., 22*a*, 24*a* which in turn is fastened to bar 11.

Figure 4:
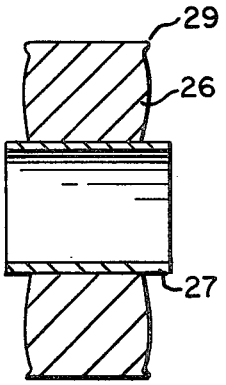
FIG. 4 is a cross-section view of a elastic textile yarn package showing the lips formed during winding.
Figure 5:
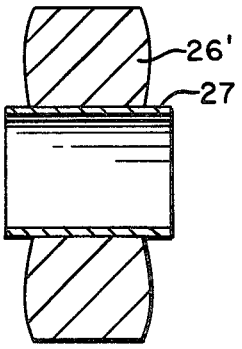
FIG. 5 is a cross-section view of the package shown in FIG. 4 after being reshaped by the apparatus of this invention.

In operation, packages 26 of elastic textile yarn normally wound on a bobbin or package support 27 have a profile in cross section as shown in FIG. 4 where a bulge or a lip 29 appears. In practice a plurality of packages 26 of the same size which are all doffed from the same spinning position are stocked to the shaper 10. The bar 11 carrying the shaping elements is pivoted back out of the way for stocking packages. In a given loading, all packages will be the same width and diameter; however, to accommodate wider yarn packages, shaping elements 32, 34 now pointing upward may be positioned downward by repositioning bar 11 which is fastened to arms 13, 15 by bolts 13*a*, 15*a*. The packages are in contact with driven rollers 14, 16 which are rotating at about 50–100 revolutions per minute and the shaping elements 22, 24 are simultaneously brought into contact with a point (e.g., 25) on the shoulders of the package and the shaping elements then apply a force of from about ¼ to about ¾ lbs to the shoulders of the package 26. The shaping operation continues for about 1–2 revolutions of the package and during this time the yarn in the lip area is moved inwardly and the package shoulder is more contoured as shown in the profile cross-section of package 26' in FIG. 5. The packages and more stable when the lip 29 has been reshaped in that the propensity for yarn to fall off the shoulder of the package is reduced. When a vacuum is applied to nozzle 28 and the packages are rotating, the free lead end of each package is picked up by the nozzle. With the free end of each package thus located it can be quickly tied around the package surface to facilitate use by the ultimate user of the package.

For the embodiments of the apparatus represented by FIGS. 1–3 and FIG. 7, the force on the package shoulders is changed by the addition of counterweights. Their function can readily be explained in the context of FIGS. 2 and 3. Between arms 13 and 15 are two ½ inch rods parallel to a line through pivot points 17. One rod 17*a* is about 2 inches inboard of pivot 17, i.e., toward the shaping rollers. Weights are hung on this rod to increase the force on the package shoulders. The other rod 17*b* is about 2 inches outboard of pivot 17. Weights are hung on this rod to decrease the force on the package shoulders.

Figure 6:
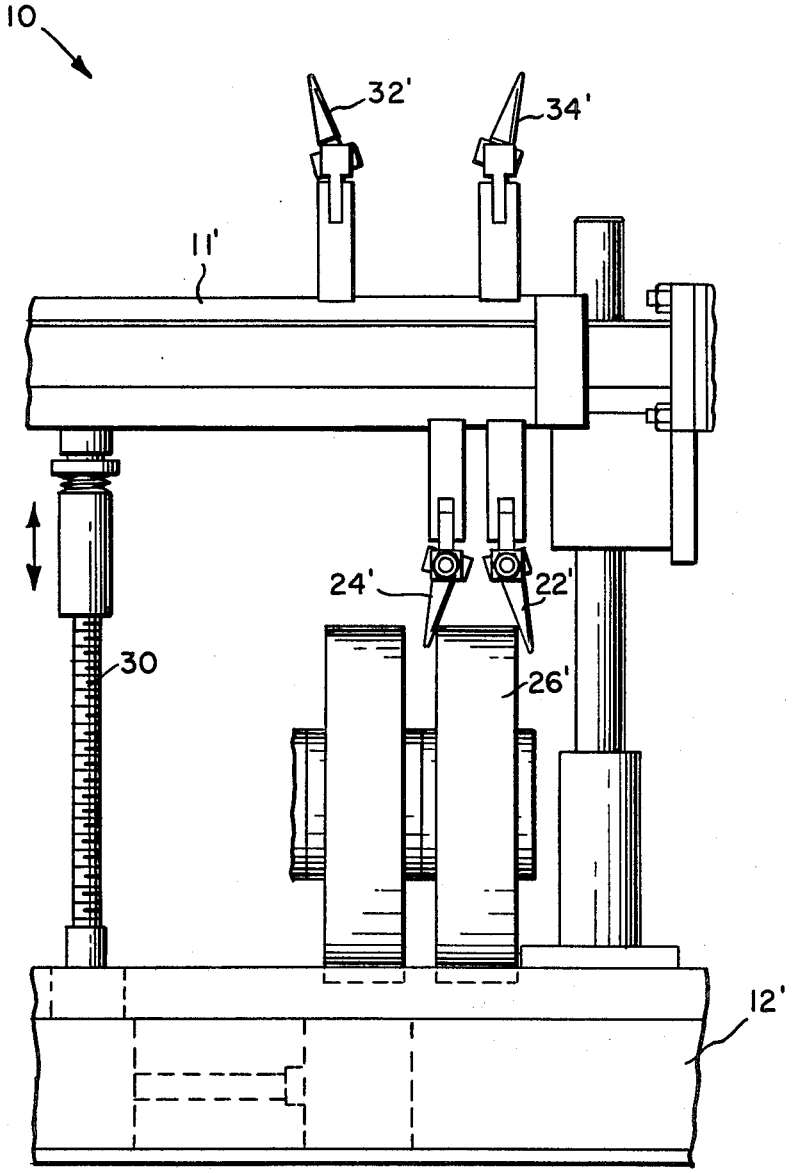
FIG. 6 is a front elevation view of another embodiment of the apparatus of this invention.

While the foregoing invention represents an improvement in the art, a still further improvement may be effected in another embodiment shown in FIG. 6. Comprising the use of a driven lead screw 30 mounted to base 12' to adjust (raise or lower) the position of element 11' carrying the shaping elements 22', 24' and 32', 34'. This permits a fine adjustment to accommodate varying package sizes and is easily automated for more effective operation.

Figure 7:
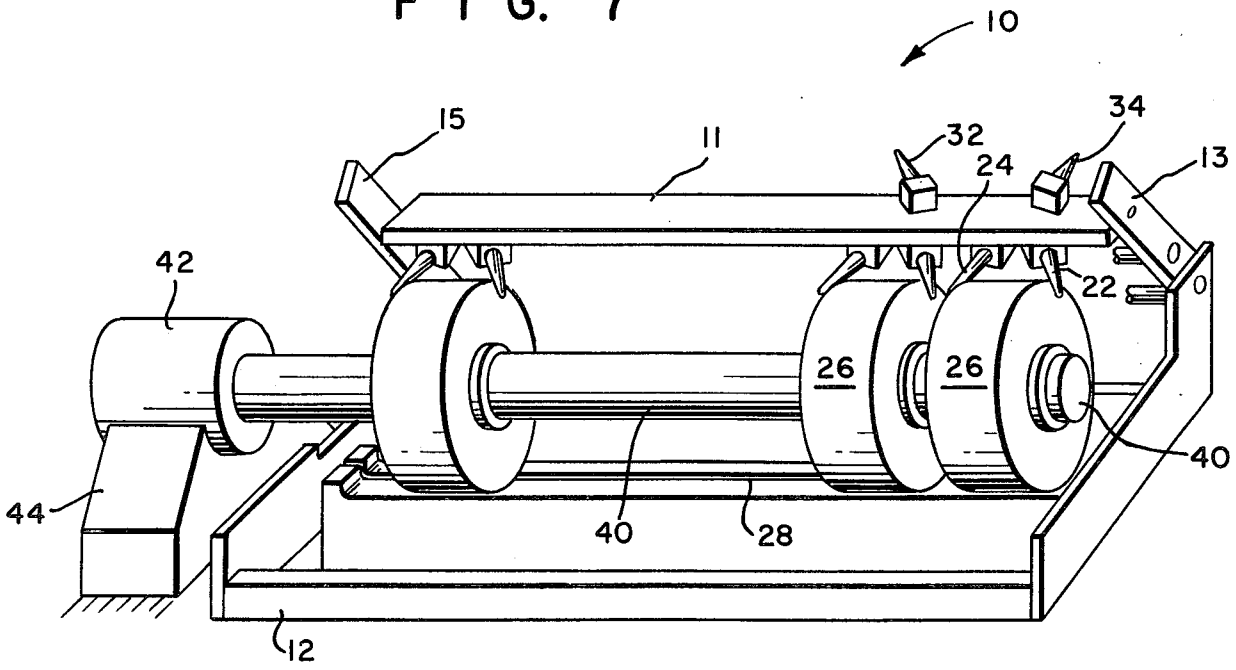
FIG. 7 is a perspective view of still another embodiment of the invention.

While the above description discloses rotating yarn packages by means of driven rollers 14, 16, other means for rotating the packages about their central axis are suitable, such as, for example, the embodiment shown in FIG. 7, wherein the yarn packages 26 are mounted on a chuck 40 which is then driven by a motor 42 mounted to support 44 adjacent the end of frame 12. The construction and operation of the shaping elements 22, 24 is the same as described in connection with FIGS. 1–3.

I claim:

1. An apparatus to shape the shoulders of a substantially cylindrical yarn package having a lip formed at the shoulders of the package, said apparatus comprising:

means for rotating said yarn package about its central axis;

a pair of rotatable elongated shaping elements movable into and out of contact with a point on said shoulders, the longitudinal axis of said shaping elements being positioned at an angle of from about 5 degrees to about 65 degrees with respect to a radius of said yarn package extending to the contact point of the shaping elements with the shoulders of the package; and means for applying a force to said elongated shaping elements, said force having a component directed toward said shoulder.

2. The apparatus as defined in claim 1, said elongated shaping elements being conical rollers having a cone angle of from about 15 degrees to about 20 degrees.

3. The apparatus as defined in claim 2, said rollers having their conical surfaces disposed with respect to each other at an included angle of from about 10 degrees to about 65 degrees.

4. The apparatus of claim 3, said included angle being from about 35 degrees to about 50 degrees.

5. The apparatus as defined in claim 1, including a suction nozzle mounted below said package in close proximity to its peripheral surface to locate a loose lead end of yarn on said package.

6. An apparatus to shape the shoulders of a substantially cylindrical yarn package having a lip formed at the shoulders, said apparatus comprising:

a base;

a pair of driven rollers rotatably mounted to the base for rotating a yarn package supported thereon, said rollers being spaced from each other in substantial parallelism;

a pair of rotatable elongated shaping elements mounted to the base for movement into and out of contact with a point on said shoulders above said rollers, the longitudinal axis of said shaping elements being positioned at an angle of from about 5 degrees to about 65 degrees with respect to a radius of said yarn package extending to the contact point of the shaping elements with the shoulders of the package; and means for applying a force to said elongated shaping elements, said force having a component directed toward said shoulder.

7. The apparatus as defined in claim 6, said elongated shaping elements being conical rollers having a cone angle of from about 15 degrees to about 20 degrees.

8. The apparatus as defined in claim 7, said rollers having their conical surfaces disposed with respect to each other at an included angle of from about 10 degrees to about 65 degrees.

9. The apparatus of claim 8, said included angle being from about 35 degrees to about 50 degrees.

10. The apparatus as defined in claim 6, including a suction nozzle mounted below said driven rollers within the space between the rollers to locate a loose lead end of yarn on said package.

11. The apparatus of claim 6, said component of force directed toward said shoulder being in the range of from about ¼ to about ¾ of a pound.

12. The apparatus as defined in claim 6, said yarn being elastic filament yarn.

13. The apparatus as defined in claim 12, said elastic yarn being a spandex fiber.

14. A method for shaping the shoulders of a substantially cylindrical yarn package after the package is wound, said package having a lip formed at the shoulders during winding of the package, said method comprising:

rotating the round package about its central axis; and applying pressure to both shoulders of the package simultaneously.

15. The method as defined in claim 14, said pressure being in the range of about $\frac{1}{4}$ to about $\frac{3}{4}$ of a pound, said yarn being elastic filament yarn.

16. The method as defined in claim 14, said elastic yarn being a spandex fiber.

* * * * *